US006539933B1

(12) United States Patent
Nordhagen

(10) Patent No.: US 6,539,933 B1
(45) Date of Patent: Apr. 1, 2003

(54) PROCESS AND DEVICE FOR SPLITTING STONES

(75) Inventor: Roar Nordhagen, Son (NO)

(73) Assignee: Stu-Stein, Teknologi og Utvikling, Son (NO)

( * ) Notice: Subject to any disclaimer, the term of this patent is extended or adjusted under 35 U.S.C. 154(b) by 0 days.

(21) Appl. No.: 09/600,098

(22) PCT Filed: Jan. 13, 1999

(86) PCT No.: PCT/NO99/00010

§ 371 (c)(1),
(2), (4) Date: Jul. 26, 2000

(87) PCT Pub. No.: WO99/36669

PCT Pub. Date: Jul. 22, 1999

(30) Foreign Application Priority Data

Jan. 15, 1998 (NO) ..... 1998 0199

(51) Int. Cl.[7] ..... B28D 1/32

(52) U.S. Cl. ..... 125/23.01; 125/24; 125/36; 125/40.41

(58) Field of Search ..... 125/23.01, 24, 125/36, 40.41

(56) References Cited

U.S. PATENT DOCUMENTS 4,114,951 A * 9/1978 Langfield et al. ..... 166/177.5

5,020,859 A 6/1991 Pesin

FOREIGN PATENT DOCUMENTS

| | | |
|---|---|---|
| EP | 0305553 | 3/1989 |
| NO | 172260 | 3/1993 |

* cited by examiner

*Primary Examiner*—Joseph J. Hail, III
*Assistant Examiner*—Allen J. Grant
(74) *Attorney, Agent, or Firm*—Ladas & Parry

(57) ABSTRACT

A tool for shell or slab-splitting rocks or for wedging rocks in tunnels comprising a hydraulic/pneumatic cylinder (2) with an internal first piston (3), said first piston (3) being provided with a hydraulic/pneumatic pressure by supplying a fluid, preferably oil, through a supply conduit (1), and the power from the piston (3) is transferred to a wedging device comprising a wedge (10) which may be displaced between wedge holders (11, 12) being located in a drilled hole (13), the piston (3) being connected to a piston rod (7) which runs to a second internal piston (8) being located in a piston housing (6), the power from the first piston (3) being transferred to the piston (8), for thereby pressing the wedge holders (11,12) towards the surrounding rock, and creating a crack therein at the appropriate pressure wherein the wedge (10) is located parallel to the lengthwise axis and peripherally in relation to the hydraulic/pneumatic cylinder (2) is disclosed. A method for splitting rocks with this tool is also indicated.

5 Claims, 4 Drawing Sheets

PROCESS AND DEVICE FOR SPLITTING STONES

FIELD OF THE INVENTION

Figure 1:
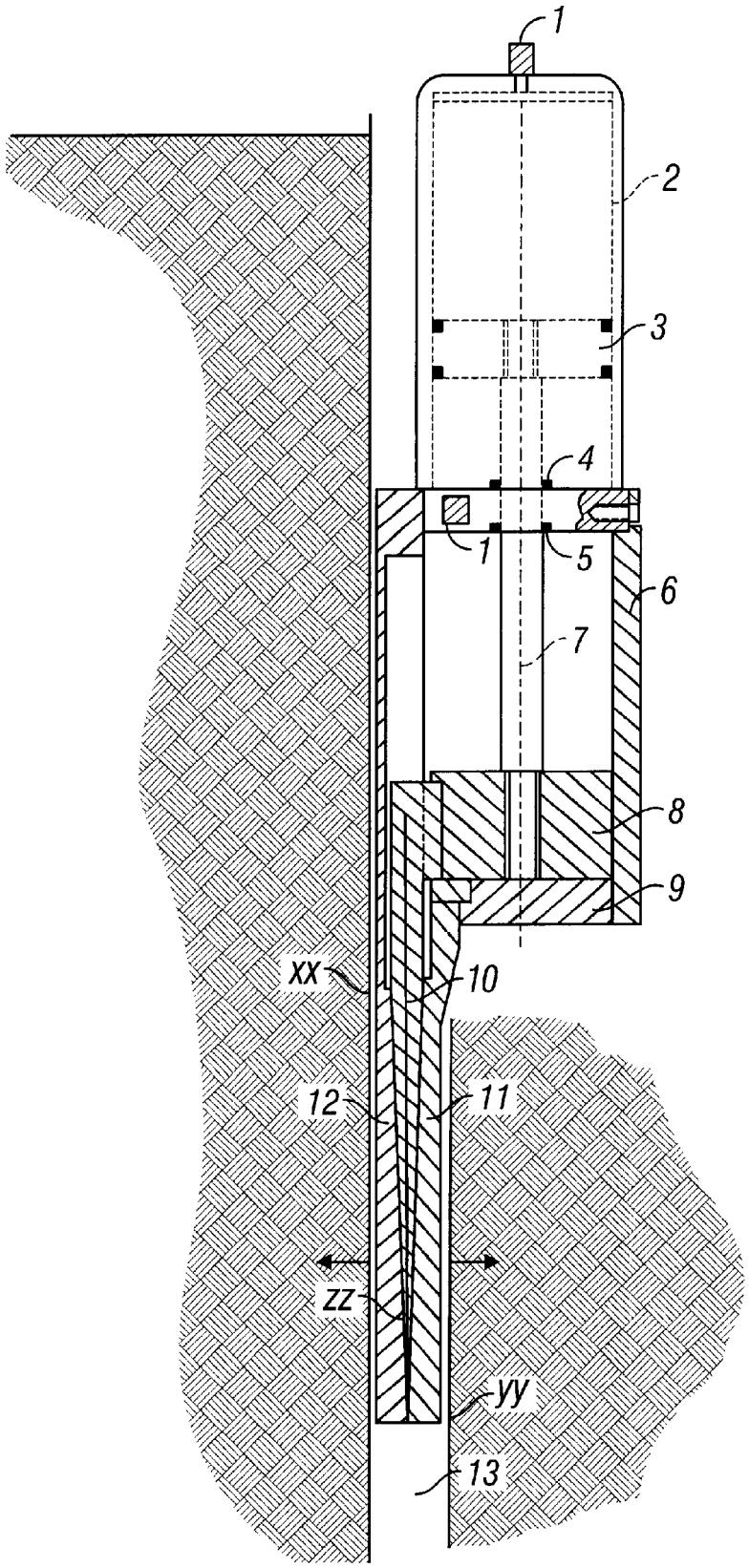

The present invention concerns a process for forming tunnels, splitting stones and especially cap or shell-splitting rocks or splitting of rocks preferably to pre-worked, square blocks, or blocks with at least one straight or plane surface. The invention also concerns a tool for performing the process.

When splitting stone blocks it is common to drill a row of parallel holes with a regular distance from each other where the splitting/parting is to take place. Explosives, expanding chemical substances or compositions and/or different types of splitting tools have conventionally been used to split rocks.

When rocks are split with explosives the explosive is filled into the previously bored holes in the rock and are detonated to loosen/split the block. Such explosive charges will also preferably be detonated simultaneously to loosen the block, and the determination of the quantity of explosives or explosive charges must be done with utmost care and precision to avoid blowing the block to pieces. Additionally, when working with natural rock or decorative stones or slabs, the stone may be damaged by the explosion, and when working with explosives there is also a risk of personnel injuries. The drawbacks with explosives are obvious since this creates a large amount of cracks. Invisible flaws may not appear until after the stone is split with explosives. Furthermore, this creates smaller or larger cracks in the stone masses left after the explosion. This is dangerous work wherein the quality of the result is at best uncertain.

When splitting rocks with expanding chemical substances or compositions, such substances will initially be filled into the bore holes and subsequently exert their expanding effect on the rock. This method is much more controllable than and less stringent than splitting the rock with explosives, but also here it is necessary to carefully measure and add the correct amount of expanding material to overcome the tensile strength of the rock, and additionally some post-handling of the split stone material will be necessary. Additionally, the splitting of rock with an expanding chemical material will be time-consuming, and this is poorly suited for use in an effective stone quarry.

When using wedges for splitting rocks according to the prior art, wedges are gradually driven into the bore holes. The driving of wedges will frequently be done with the use of a sledgehammer/pneumatic piledriver and eventually the wedges will overcome the tensile strength of the rock, resulting in the rock splitting.

The most common way to drive the wedges manually into the rock is by predrilling the splitting holes as indicated supra. A number of wedges are then placed inside the predrilled holes, and they are then driven sequentially and manually into the holes by starting the splitting at one edge of the rock, driving the wedge nearest to the edge into its hole, then driving the next wedge in the hole adjacent to the first one downwards into its hole, etc; and when reaching the farthest edge of the rock repeating the driving sequence until a slab is split from the rock. This manual splitting is obviously very time-consuming and cumbersome, and it is difficult to split rock slabs off from the mother rock beyond the reach of the wedge or splitting tool.

Work with different types of splitting tools are also associated with danger, albeit less than when using explosives, and such splitting of rock may also be used under conditions where blowing-up the rock with explosives is neither possible or nor suitable. However, the splitting of the rock puts certain demands on the splitting tool, and the splitting of slabs or blocks of rock has until today been difficult because it has not been possible to guide the splitting of the rock sufficiently by using conventional splitting tools.

DESCRIPTION OF RELATED ART

In Norwegian patent 13.161 there is shown a splitting tool wherein a gliding wedge is compounded with a piston rod in the centre axis of a hydraulic cylinder, and wherein two or more insert pieces with a circular cross section are connected with the cylinder housing. The insert pieces have angular surfaces which downwards forms a narrowing wedge space. There arise tensile forces in the stone block from the bore hole when the sliding wedge gradually is pressed into the wedge space by using hydraulic pressure. The drawback with this tool lies inter alia in the location of the sliding wedge in the centre of the tool, since this makes it impossible to split thin slabs off stone blocks and it is furthermore impossible to split off slabs farther down the slab than the length of the wedge tool. Each wedge is additionally a very heavy unit and is poorly suited for any practical production of natural stone slabs or working in tunnels. In addition the wedges must have a suitable hydraulic aggregate on account of the high pressure which is necessary to build up in the tool, a pressure which depends on the rock type which is to be split, and which with rock types with a large tensile strength may be relatively significant.

Another drawback with a splitting tool which formerly is known from Norwegian patent 113.161 is that such a tool comprises a central piston rod in the wedge and which passes the insert pieces placed in the drilled hole in the rock to be split. Since the central piston rod in the wedge passes the insert pieces, which consequently are pushed aside and pressed against the sides of the drilled hole, the piston rod may easily become stuck in the bottom of the drilled hole or it may break, something which in turn leads to a reduced efficiency because inordinately long drilling holes must be drilled when using this type of tool. Additionally the wedge disclosed in this prior art patent, is not able to split the rock in close proximity to a surface on account of the total circumference of the cylinder being significantly larger than the wedge itself. Furthermore it is a drawback that all of the force from the wedge is distributed over a very small surface so that the rock consequently may be damaged in the breaking zone and lead to a poor product.

It is known from Norwegian patent 172.260 a tool for splitting rocks wherein the tool comprises a securing bolt to be introduced into a predrilled hole in the stone block. The splitting tool comprises additionally an arm mechanism being guided by a hydraulic cylinder with an impingement point against the stone block at a given distance from the drilled hole, and which also works as an anchorage point for the securing bolt of the tool. When supplying hydraulic oil to the hydraulic cylinder, the tool is given a pushing force from the impingement point on the stone block so that a tilting movement arises in the tool. This has as a consequence that the securing bolt is tilted against the adjacent sides of the drilled hole so that tensile scissoring forces arise in the rock. The drawback of such a splitting method is that the wedge will have a point-formed breaking force so that there arises a large degree of deformations around the breaking point, and when splitting thin slabs there will be created a very irregular block form in the product since the wedges exert force against the surface instead of creating initial cracks against the drilled hole at its side. Blocks with such an uneven form are not desirable for potential receivers of the raw blocks.

U.S. Pat. No. 5,020,859 discloses a splitting tool designed so that the wedges are not produced with so small a diameter so that they may be used for producing natural rocks or in the entrepreneur trade. An example given in this patent is based on drilling holes with a diameter over 105 mm, something which is unsuitable for slab-splitting thin stone slabs. In addition this tool is meant to split[ting of] materials with a very high cohesive strength, e.g. for destroying armed concrete.

SUMMARY OF THE INVENTION

For splitting stone having been equipped with a number of drilling holes being located along a substantially straight line and being substantially straight along the axis of the drilling holes, a tool is thus required giving impingement points which mainly lie diametrally across from each other inside the drilling hole. It is also an advantage that the splitting force is located far inside the drilling hole.

Such splitting of rocks as disclosed supra is called shell or slab-splitting. The slab-splitting of today is otherwise done mainly manually and with a sledgehammer, wedge and wedge holders, and this is often a dangerous and cumbersome work. There has also been developed a hydraulic/pneumatic tool for such slab-splitting wherein a hydraulic/pneumatic power hammer, however, working within the same principles as manual splitting, this method has not had any development or been refined within the last 30 years. Consequently there is a need for an improved, safer and less cumbersome method for splitting rocks wherein the safety is better and wherein the waste percentage may be reduced.

In the Norwegian and foreign block stone industry of today there is a need for a tool which covers all the needs for working rocks in such a way that it is to a large extent possible to avoid explosives completely. There exists a particular need for a tool which may be used for slab-splitting, a process which is most work-consuming within the stone block industry and which also is the working form which causes most injuries to the working personnel.

With the present invention there has been produced a process for splitting rocks wherein there has been pre-drilled a number of holes in the rock, and wherein the holes preferably mainly lie along an imaginary line in the rock. The splitting tool being used in the process comprises wedge holders which are placed inside one or more of the drilling holes in the rock, wherein the points of attack for the wedge holders for splitting the rock lie mainly adjacent each other in the drilled hole and where the wedge holders are oriented parallel with the imaginary line between the drilled holes, the splitting tool with the wedge holders expand more than the diameter of the drilled holes when the expanding force being supplied to between the wedge holders surpasses the tensile strength of the rock so that there is created initial cracks between the drilling holes, where these cracks are expanded downwards along the axis of the drilled holes in the rock by the further expansion of the wedge. As disclosed supra this is achieved when the rock which is to be split is supplied with at least one hole wherein there may be introduced a number of wedges. By placing one or more wedges inside the hole the wedging force will work radially outwards in the hole with points of attack mainly across from each other inside the hole, and the rock will be forced apart by the creation of cracks in the rock where the cracks run mainly along the axis of the drilled holes, by the wedge pressing the wedge holders apart to a diameter surpassing the diameter of the respective predrilled hole and which surpasses the tensile strength of the rock. In this way blocks may be split from the rock wherein the holes have been drilled. In the process according to the invention the wedge holders 11,12 are pressed towards the periphery of the drilled hole with the back zz of the wedge against the inner wedging surface xx. When the hydraulic/pneumatic pressure becomes greater than the tensile strength of the stone, an initial crack will be created between the two adjacent holes, which will extend and at last create an open crack along the imaginary line between the holes, where the rock wall left in the stone block is called the inner surface xx, and the other rock wall which becomes removed, is called the outer surface yy. The process according to the invention is further distinguished by being performed with a tool as disclosed infra, where the wedge holders press against the periphery of their relevant hole so that the outer surface yy is broken away and the inner surface xx is left, where the spine of the wedge will follow the inner surface xx and remove the rest of the rock material in a successive sequence of the one disclosed supra.

By placing a number of wedges successively in rows and successively pressing the wedge holders radially apart it is in principle possible to split as large stone blocks as wanted by this method. In practice, however, there will be limitations on the method in that it will not be possible to split blocks of an unlimited size, but these limitations will be obvious to the person skilled in the art based on the knowledge of the nature of the relevant rock, or they may be determined by conventional and simple tests. By staying within the practical upper limits for such splitting of rocks the above indicated problems may, however, easily be avoided.

When splitting rocks the natural rocks, fall into three main groups: Block stone (types of gneiss and granite), slate and marble.

Block stone is produced from rock types which may be broken in large blocks and are formed in rectangular and quadratical shapes for further work-up such as for building purposes and monuments. In Norway this is not used to any large extent domestically, so most of the material is exported with a price established per cubic meter. E.g. when working with larvikitt which has a waste percentage of about 95%, 1% less waste will mean about 20% more material to be sold. Normally the waste percentage in workable quarries will be up to 98%. The reduction of this waste percentage is one of the advantages with the present splitting method and tool.

Concerning slate, the process and device according to the present invention gives a new and better opportunity to use less explosives and thus reduces the waste percentage. Slate deposits are worked by there first being split off a large stone block from the mountain. When the block has been loosened, the final slate slabs are produced by drilling and splitting. By using the process and tool according to the invention the person working the quarry will get a better total economy on account of a lower waste percentage and a better efficiency.

In addition to the production of block stone the process and tool according to the invention may also be used for e.g. expanding tunnels, be it train tunnels, water tunnels or other kinds of tunnels where explosives may not be used, and the method and tool may also be used if there exist a need for splitting rocks at other places where explosives may not be used, such as in highly populated areas.

The same method being disclosed supra for block stones and slate may also be used "for splitting" marble.

The present invention also concerns a tool which may be used in the process according to the invention for splitting rocks, e.g. in controlled splitting of loose blocks of rock. Loose blocks of rock are often found on agricultural properties and on industrial and domestic house sites.

Both the process and the tool according to the invention may be used where a controlled splitting of rocks is wanted independent from what kind of rocks are split or what kind of splitting is wanted, be it splitting of block rocks, slate, marble, or when expanding tunnels etc..

An embodiment of a tool according to the invention will be disclosed infra with reference to the enclosed FIGS. 1–3*a–d.*

BRIEF DESCRIPTION OF DRAWINGS FIGURES

Figure 2:
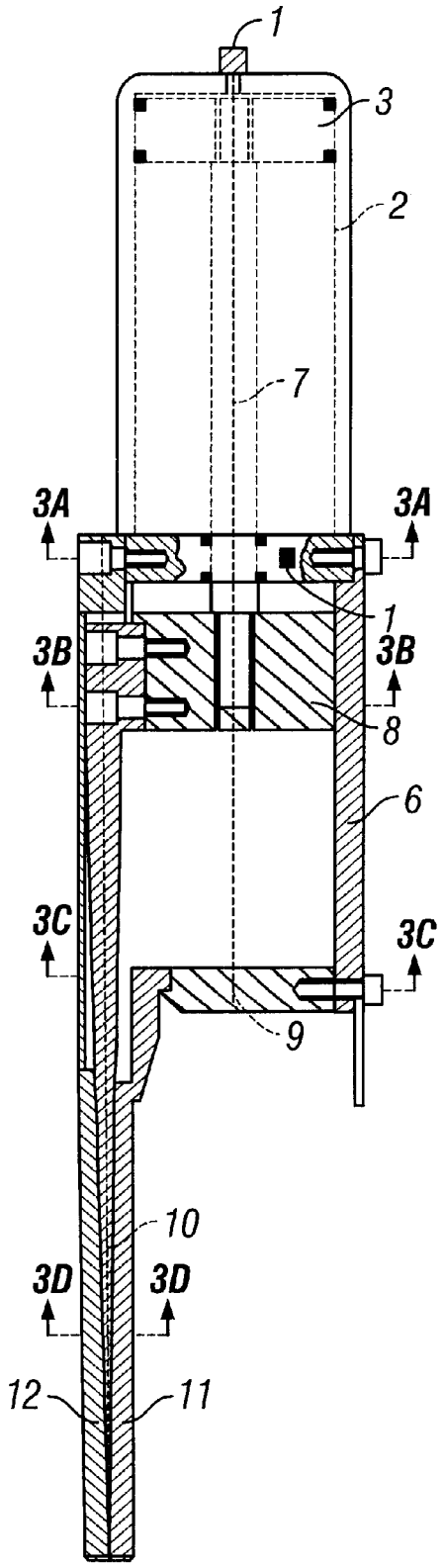
Figure 3A:
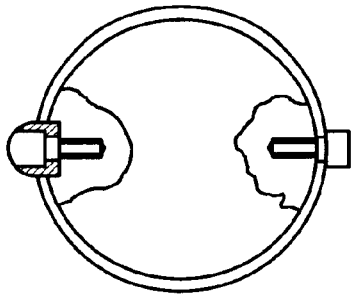
Figure 3B:
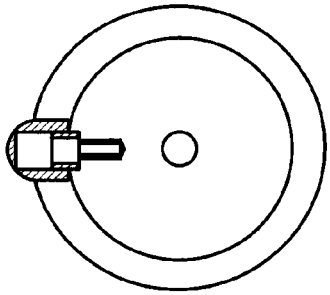
Figure 3C:
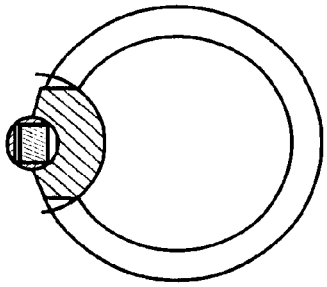
Figure 3D:
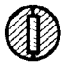

FIG. 1 shows the structure of an embodiment of the wedging tool according to the invention being used in wedge-spitting of rock, FIG. 2 shows a corresponding tool as shown in FIG. 1, but with reference lines for figure sections, and FIG. 3*a–d* show the different cross sections as indicated in FIG. 2.

The set of figures comprises furthermore the

Figure 4:
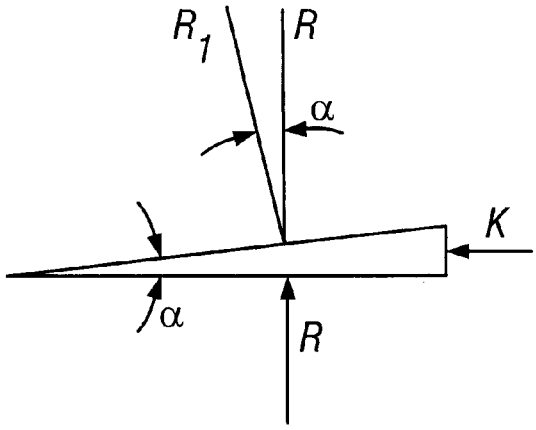
Figure 5:
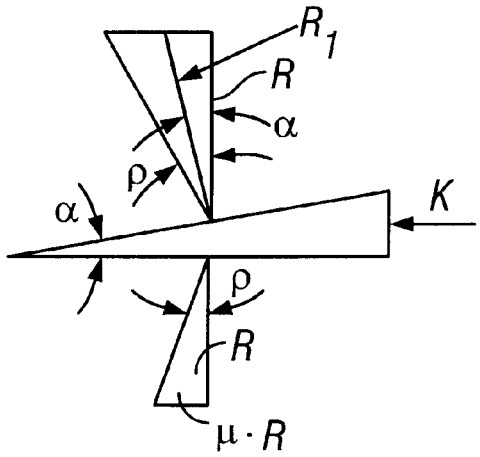
Figure 6:
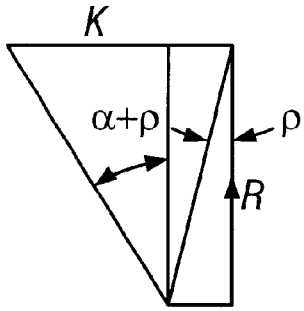

FIGS. 4–6 where there are shown purely general considerations concerning the wedging angle of the wedge tool according to the invention.

DETAILED DESCRIPTION OF THE PREFFERRED EMBODIMENTS

The invention concerns a hydraulic, pneumatic or mechanical, but preferably hydraulic/mechanical device as is indicated in the FIGS. 1–3*a–d*. The device is a tool for wedge-splitting rocks, comprising a hydraulic cylinder 2 with an internal piston 3, the movement of which is effected by a hydraulic or pneumatic pressure, preferably an oil-hydraulic pressure. The oil pressure supplied to the piston 3 is transferred by a sliding wedge 10 which may be driven between two wedge holders 11,12 located inside a drilled hole. The hydraulic pneumatic unit is driven by a fluid, preferably oil, supplied via an oil connection 1. The pressure in the oil cylinder may be regulated, and the oil cylinder is furthermore equipped with O-rings 4,5 sealing against oil leakage. The hydraulic cylinder 2 has circumferentially and around its sides mounted a housing 6 surrounding the hydraulic cylinder 2 which supports and connects to the cylinder of the piston 3. The internal piston 3 is connected to a piston rod 7 and transfers its power to a second piston 8 running inside the housing 6. In the bottom of the housing 6 there is located an end cap 9. The power from the hydraulic/pneumatic piston 3 will in this device be transferred via the piston rod 7 to the second piston 8 running inside the housing 6, and subsequently to the sliding wedge 10 so that this wedge may be driven between the wedge holders 11,12 and expanding the distance between them.

In the tool according to the present invention the power is transferred from a double-action hydraulic cylinder to a wedge at its outer diameter so that the splitting is performed at the outer circumference of the tool, and not in an elongation of its central axis. The consequence of this is that the splitting tool according to the invention covers all suitable use areas for drilled holes, e.g. with drilled holes from 18 mm to 108 mm in diameter. The tool is in each and any case adjusted to fit the diameter of the drilled hole. Such diameters will normally lie within the interval of 24 to 76 mm, but the size of the drilled holes are not critical for the scope of the invention. The tool according to the invention may be used for wedging primary and secondary excavations in stone/tile quarries, and in further post-treatment up to the final article or product. In the method used today stone blocks are loosened from the mountain by drilling, exploding or by sawing with a diamond wire. Estimated from the tensile strength of the rock the working pressure will normally lie within the interval 150–200 bars with a piston diameter of 80 mm, a stroke length of 100 mm and with an inclination of the wedge in the interval of 0–5 mm per 100 mm. This gives a splitting effect of 12 mm.

Otherwise the diameter of the wedge, the stroke length and the angle of the wedge will vary with the diameter of the predrilled hole, and also with the stone type which is to be shell-split. Generally wedges are separated into several groups in relation to their area of use, an comprise generally two main groups, i.e securing wedges and adjustment wedges. Securing wedges are used to secure or combine two parts, adjustment wedges are used to adjust two parts in relation to each other. In the present case of shell-splitting of rocks, adjustment wedges are generally used. For the sake of completeness it will be mentioned that securing wedges should have a small angle so that they become self-blocking, usually with an angle of $1/15$–$1/100$, whereas the adjustment wedges will have a larger angle, usually in the interval $1/5$–$>1/15$. The adjustment wedges do not then become self-blocking and have to be secured against sliding or displacement in the hole.

A third group, of wedges are cross-wedges, being wedges where the length of the wedges run transversally of the length of those parts which are to be secured together. If the lengthwise direction of the wedge coincides with the lengthwise direction of the those parts which are to be combined, then the wedge is called a length wedge.

In FIGS. 4–6 there are indicated purely general features in connection with considerations which may be done when choosing the wedge type. With wedges having a small angle between the wedge surfaces, a large wedging force R may be achieved with a small instroke power K. If the friction is disregarded, a splitting will be achieved when K>R tg=$R_1$ sin and $R_1$=R/cos. When the friction is included (see FIG. 6), one gets on account of the pressure forces R and $R_1$ a frictional force $F_0=\mu R$ along one wedge surface and $F_1=\mu R_1$ along the other wedge surface, wherein $\mu$ is the relevant frictional coefficient.

The frictional forces will act against the movement of the wedge. If, instead of the frictional coefficient $\mu$, there is introduced the corresponding frictional angle ρ determined by $\mu$=tg ρ then $K=R.tg(\alpha+\rho)+R\ tg\ \rho$ for engagement, or $K=R.(tg\ \alpha+2\mu)$ $K=R.tg(\alpha-\rho)-R.tg\ \rho$ when loosening the wedge.

For steel against steel the frictional coefficient is $\mu$=0.05–0.1 with lubrication with fat, with oil lubrication $\mu$=0.10–0.15 and with dry surfaces $\mu$ is about 0.22. In the present situation it will normally be sufficient to estimate the frictional coefficient to be about $\mu$=0.22 between the wedging tool and the wedge holders.

Use of drilling and hydraulic wedging in tunnels is not a very widespread method and has thus a very large growth potential. This is especially relevant in countries where, on account of different situations and circumstances, it is difficult to get access to explosives, or in areas where the rock types are very loose so that explosives are not very recommendable or indeed safe. These are inter alia the reasons for the process and the tool according to the present invention having a large potential when wedging rocks under almost any condition.

EXAMPLE 1

In a full profile operation in a tunnel with a loose rock configuration, it often is encountered a different kind of rock which the full profile equipment is not able to penetrate. Since it is not possible to use explosives, it is convenient to use drilling and wedging. A pilot hole with a diameter of 5" (12.7 cm) is drilled and the wedging is performed against this. The wedging holes are drilled with a diameter of 32 mm with and a length of 3 m. It is possible with the wedging tool according to the invention to wedge along the entire drilling length.

EXAMPLE 2

To shell-split a stone block of larvikitt into blocks of dimensions 1.60×3.0×2.0 m there was used pre-drilled holes with a diameter of 24 mm throughout the entire depth of the stone. The holes were laid in a line with a mutual distance of 1–20 cm from each other. Into these holes there were placed wedge holders with dimensions 22.8 mm along the imaginary line between the holes so that when wedging the stone block there will be removed a plate-formed stone slab from the stone block with dimensions of at least the length between the outermost drilling holes. (If the holes run along the entire length of the stone block, a stone slab will be removed from the stone block which has a length which is equal to the length of the stone block.) The wedge holders are placed inside the holes. Between the wedge holders there was placed a wedge according to the invention with a diameter of 18 mm. When supplying pressure dependent on the splitting direction of the rock (counter/splitting direction) of 100 bars in the splitting direction of the rock to the piston of the splitting tool for driving the wedge of the wedging tool between the wedge holders inside the holes, the stone became split.

The working hydraulic/pneumatic pressure in the wedging tool according to the invention lies preferably, although not exclusively, in the interval of 150–200 bars. The drilled holes in the rock lies also preferably, but not exclusively, in the interval of 18–108 mm, and the drilled holes have preferably, but not exclusively, a length of at least 100 mm. The splitting effect of the tool according to the invention will as an example have a splitting effect of 175 tons at a pressure in the hydraulic/pneumatic cylinder of 175 tons.

What is claimed is:

1. Tool for shell or slab-splitting rocks or for wedging rocks in tunnels comprising a hydraulic/pneumatic cylinder with an internal first piston, said first piston being provided with a hydraulic/pneumatic pressure by supplying a fluid through a supply conduit, and the power from the piston is transferred to a wedging device comprising a wedge which may be displaced between wedge holders being located in a drilled hole, the piston being connected to a piston rod which runs to a second internal piston being located in a piston housing, the power from the first piston being transferred to the second piston, for thereby pressing the wedge holders towards the surrounding rock, and creating a crack therein at the appropriate pressure, wherein the wedge is located parallel to the lengthwise axis and peripherally in relation to the hydraulic/pneumatic cylinder.

2. Wedging tool according to claim 1, wherein the hydraulic/pneumatic cylinder is designed to work at a pressure in the interval from 150–200 bars.

3. Wedging tool according to claim 1, wherein the tool is suited to fit drilled holes with a diameter in the interval from 18–108 mm and which has a length of at least 100 mm.

4. Wedging tool according to claim 1, wherein the tool has a splitting effect of 175 tons at a pressure in the pneumatic/hydraulic cylinder of 175 tons.

5. Wedging tool according to claim 1, wherein the fluid supplied through the supply conduit is oil.

* * * * *